US007215310B2

(12) United States Patent
Song et al.

(10) Patent No.: US 7,215,310 B2
(45) Date of Patent: May 8, 2007

(54) LIQUID CRYSTAL DISPLAY DEVICE

(75) Inventors: Hong Sung Song, Kyoungsangbuk-do (KR); Keuk Sang Kwon, Kyoungsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 94 days.

(21) Appl. No.: 10/096,911

(22) Filed: Mar. 14, 2002

(65) Prior Publication Data

US 2002/0163488 A1 Nov. 7, 2002

(30) Foreign Application Priority Data

Mar. 20, 2001 (KR) ..... 2001-14221

(51) Int. Cl.
*G09G 3/36* (2006.01)

(52) U.S. Cl. ..... 345/94; 345/96

(58) Field of Classification Search ..... 345/87–104, 345/204, 211–213, 205
See application file for complete search history.

(56) References Cited

U.S. PATENT DOCUMENTS 5,159,476 A * 10/1992 Hayashi ..... 349/39
5,568,163 A * 10/1996 Okumura ..... 345/100
5,790,090 A * 8/1998 Libsch et al. ..... 345/94
5,963,190 A * 10/1999 Tsuboyama et al. ..... 345/103
6,031,514 A * 2/2000 Hashimoto et al. ..... 345/94
6,037,925 A * 3/2000 Kim ..... 345/99
6,115,018 A * 9/2000 Okumura et al. ..... 345/95
6,414,664 B1 * 7/2002 Conover et al. ..... 345/89
6,515,646 B2 * 2/2003 Tokonami et al. ..... 345/96
6,590,552 B1 * 7/2003 Yokoyama et al. ..... 345/92
2001/0043178 A1 * 11/2001 Okuzono et al. ..... 345/87

FOREIGN PATENT DOCUMENTS

EP 00376 329 A2 * 12/1989
JP 2000-010531 * 1/2000

* cited by examiner

*Primary Examiner*—Alexander Eisen
(74) *Attorney, Agent, or Firm*—Morgan, Lewis & Bockius LLP

(57) ABSTRACT

A liquid crystal display device includes a plurality of data lines on a liquid crystal display panel, a plurality of gate lines on the liquid crystal display panel orthogonal to the plurality of data lines, a plurality of thin film transistors on the liquid crystal display panel, each arranged at intersections between the data lines and the gate lines, a plurality of pixels, each arranged at the intersections between the data lines and the gate lines, a gate driver for applying a scanning pulse to the gate lines, a data driver for applying data to the data lines, a timing controller for applying a timing signal to the gate driver and the data driver, a host controller for applying the data to the data driver and applying a horizontal synchronizing signal having a first frequency and a vertical synchronizing signal having a second frequency less than 60 Hz to the timing controller to control the data driver and the timing controller, a plurality of auxiliary lines, each provided on the liquid crystal display panel for applying a first voltage, and a plurality of storage capacitors, each connected to a corresponding one of the auxiliary lines to charge a second voltage from the auxiliary line in a scanning interval of a pre-stage scanning line.

20 Claims, 7 Drawing Sheets

FIG.9

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG.10

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

LIQUID CRYSTAL DISPLAY DEVICE

The present invention claims the benefit of Korean Patent Application No. P2001-14221 filed in Korea on Mar. 20, 2001, which is hereby incorporated by reference.

BACKGROUND OF THE INVENTION

1. Field of the Invention

This invention relates to a display device, and more particularly to a liquid crystal display (LCD) device.

2. Description of the Related Art

Generally, a liquid crystal display (LCD) device uses a pixel array matrix disposed at intersections of gate and data lines, thereby display image data corresponding to video signals.

FIG. 1 is a schematic block diagram showing an LCD according to the conventional art. In FIG. 1, the conventional LCD includes a liquid crystal display panel 12 for displaying image data corresponding to video signals, a host controller 1 for generating video signals 2R, 2G and 2B, a vertical synchronizing signal V, and a horizontal synchronizing signal H, a data driver 8 for applying the video signals to data lines DL of the liquid crystal display panel 12, a data controller 4 arranged between the host controller 1 and the data driver 8 to apply the video signals 2R, 2G and 2B from the host controller 1 to the data driver 8, a gate driver 10 for applying a scanning signal to gate lines GL of the liquid crystal display panel 12, and a timing controller 6 arranged between the host controller 1 and the gate driver 10 to apply the vertical and horizontal synchronizing signals V and H from the host controller 1 to the data driver 10 and the gate driver 8, respectively.

The host controller 1 applies the video signals 2R, 2G and 2B stored in a video RAM (not shown) to the data controller 4. In addition, the host controller 1 includes a vertical synchronizing signal oscillator 3 for creating the vertical synchronizing signal V, and a horizontal synchronizing signal oscillator 5 for creating the horizontal synchronizing signal H. The vertical synchronizing signal oscillator 3 generates a 60 Hz vertical synchronizing signal V and applies it to the timing controller 6. The horizontal synchronizing signal oscillator 5 generates a horizontal synchronizing signal H and applies it the timing controller 4.

The data controller 4 receives the video signals 2R, 2G and 2B from the host controller 1 to apply the video signals 2R, 2G and 2B to the data driver 8 on a serial transmission basis. The timing controller 6 applies the 60 Hz vertical synchronizing signal V from the host controller 1 to the gate driver 10, and applies the horizontal synchronizing signal H from the host controller 1 to the data driver 8.

The horizontal synchronizing signal H is generated by the horizontal synchronizing signal oscillator 5 according to the following equation:

$$H = \text{Vertical resolution} * V * 1.05 \quad (1)$$

The data driver 8 is synchronized with the horizontal synchronizing signal H from the timing controller 6 to apply video signals 2R', 2G' and 2B' from the data controller 4 to the data lines DL of the liquid crystal display panel 12, line by line. More specifically, the data driver 8 latches each of red (R), green (G) and blue (B) data inputted sequentially in conformity to a clock of the horizontal synchronizing signal H from the timing controller 6, thereby changing the timing system from the dot at a timing scanning into the line at a timing scanning. Subsequently, the data driver 8 transfers data stored in a first latch (not shown) to a second latch (not shown) in conformity to a transfer enable signal every period of the horizontal synchronizing signal H. The data stored in the second latch is converted into an analog voltage by an analog to digital converter (not shown) and then is applied to the data lines DL via a current buffer (not shown).

The gate driver 10 is synchronized with the vertical synchronizing signal V from the timing controller 6 to sequentially create a gate pulse for applying the video signals 2R', 2G' and 2B' from the data lines DL to each pixel, thereby applying the gate pulse to gate lines GL of the liquid crystal display panel 12. More specifically, the gate driver 10 includes a shift register (not shown) for shifting a start pulse, in which a logic input value of the vertical synchronizing signal V is high, sequentially at one line time intervals, a level shifter (not shown) for converting an output logic level of the shift register into an on/off voltage of the gate line GL, and a current buffer (not shown) for amplifying a current in corresponding to a load of the gate line GL. Such a configuration sequentially applies a scanning pulse, which is an on/off signal, to the gate lines GL.

More specifically, the shift register of the data driver 8 is supplied with video signals sequentially pixel by pixel to store the video signals corresponding to the data lines DL. Subsequently, the gate driver 10 outputs a gate line selection signal to sequentially select any one of a plurality of gate lines GL. A plurality of TFT's connected to the selected gate line GL are turned on to apply video signals stored in the shift register of the data driver 8 to the source terminal of the TFT, thereby displaying the video signals on the liquid crystal display panel 12. Thereafter, the operation as mentioned above is repeated to display the video signals on the liquid crystal display panel 12.

In FIG. 2, the liquid crystal display panel 12 includes a thin film transistor (TFT) arranged at each intersection between the gate lines GL and the data lines DL, thereby functioning as a switch. A pixel electrode 14 is arranged between a pre-stage gate line GL-1 and the TFT.

The TFT functions as a switch that loads and breaks a signal voltage onto and from a pixel electrode 14. A gate terminal of the TFT is connected to the gate line GL, and a drain terminal of the TFT is connected to the pixel electrode 14. The pixel electrode 14 includes a storage capacitor Cst provided between the pre-stage gate line GL-1 and the drain terminal of the TFT, and a liquid crystal cell Clc connected between the drain terminal of the TFT and a common voltage terminal Vcom at an upper substrate (not shown). The pixel electrode 14 is an area that transmits and shuts off light. The pixel electrode 14 applies a data voltage to a liquid crystal layer (not shown), thereby displaying image data. Accordingly, a pixel voltage is applied to the pixel electrode 14 to display image data. The storage capacitor Cst improves a sustaining characteristic of a liquid crystal application voltage, thereby stabilizing a gray scale display and maintaining a pixel information during a non-selection interval of a pixel. The storage capacitor Cst charges a data voltage from the pre-stage gate line GL-1 upon scanning of the gate line GL.

In FIG. 3, the storage capacitor Cst charges a positive voltage during an 1H interval when a scanning pulse is turned ON. The voltage charged on the storage capacitor Cst is maintained during 1 frame after a scanning pulse was turned OFF. However, a method of driving a liquid crystal display device using the storage capacitor Cst connected to the pre-stage gate line GL-1 has a problem in that a high voltage at the pre-stage gate line GL-1 is derived into the storage capacitor Cst upon data charging of the storage capacitor Cst into the gate line GL and added to a pixel voltage. For example, when a gate voltage is 20V, a derived voltage ΔV having a very high value of about 10V is applied to the pixel. Since the voltage applied to the pixel is a combination of the derived voltage ΔV and a charged voltage Vpixel, image data displayed on the liquid crystal display panel 12 is distorted. Moreover, since the applied voltage is approximately three times larger than a normal voltage applied to a normal pixel, a liquid crystal layer is subjected to a large liquid crystal displacement. Accordingly, such a liquid crystal displacement results from a rising time as given by the following equation:

$$\text{Rise Time}(\tau_{ON}) = \frac{r_1 * d^2}{\varepsilon_0 * \Delta\varepsilon * (V^2 - V_{th}^2)} \quad (2)$$

A variation of the rising time influenced by the pre-stage gate line GL-1 when a charged voltage Vpixel is 5V is indicated by the following equation:

$$\text{Rise Time}(\vartheta_{ON}) = \frac{r_1 * d^2}{\varepsilon_0 * \Delta\varepsilon * (15.0^2 - 1.0^2)} \quad (3)$$

wherein, if there is an effect of the pre-stage gate line GL-1, Vth=1.0V and ΔV=10V.

As previously described, the pixel voltage V is 15V because it is an addition of the derived voltage ΔV to the charged voltage Vpixel, due to the effect of the pre-stage gate line GL-1. Since the rising time $\tau_{ON}$ is inversely proportional to a square of the pixel voltage V, the rise time increases rapidly. Accordingly, a liquid crystal response increases, thereby causing liquid crystal displacement. This sudden liquid crystal displacement causes a brightness change per frame, thereby generating a flicker phenomenon.

SUMMARY OF THE INVENTION

Accordingly, the present invention is directed to a liquid crystal display device that substantially obviates one or more problems due to limitations and disadvantages of the relate art.

An object of the present invention is to provide a liquid crystal display device having reduced flicker.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, a liquid crystal display device includes a plurality of data lines on a liquid crystal display panel, a plurality of gate lines on the liquid crystal display panel orthogonal to the plurality of data lines, a plurality of thin film transistors on the liquid crystal display panel, each arranged at intersections between the data lines and the gate lines, a plurality of pixels, each arranged at the intersections between the data lines and the gate lines, a gate driver for applying a scanning pulse to the gate lines, a data driver for applying data to the data lines, a timing controller for applying a timing signal to the gate driver and the data driver, a host controller for applying the data to the data driver and applying a horizontal synchronizing signal having a first frequency and a vertical synchronizing signal having a second frequency less than 60 Hz to the timing controller to control the data driver and the timing controller, a plurality of auxiliary lines, each provided on the liquid crystal display panel for applying a first voltage, and a plurality of storage capacitors, each connected to a corresponding one of the auxiliary lines to charge a second voltage from the data line in a scanning interval of a scanning line.

In another aspect, a method for driving a liquid crystal display device that includes a plurality of data lines on a liquid crystal display panel, a plurality of gate lines on the liquid crystal display panel orthogonal to the plurality of data lines, a plurality of thin film transistors on the liquid crystal display panel, each arranged at intersections between the data lines and the gate lines, and a plurality of pixels, each arranged at the intersections between the data lines and the gate lines, the method includes applying a scanning pulse to the gate lines using a gate driver, applying data to the data lines using a data driver, applying a timing signal to the gate driver and the data driver using a timing controller, applying the data to the data driver and applying a horizontal synchronizing signal having a first frequency and a vertical synchronizing signal having a second frequency to the timing controller to control the data driver and the timing controller using a host controller, applying a first voltage to a plurality of auxiliary lines, each provided on the liquid crystal display panel, and charging a plurality of storage capacitors, each connected to a corresponding one of the auxiliary lines, with a second voltage from the data line during a scanning interval of a scanning line.

In another aspect, a liquid crystal display device includes a liquid crystal display panel, a plurality of gate lines on the liquid crystal display panel, a plurality of data lines on the liquid crystal display panel orthogonal to the plurality of gate lines, a plurality of auxiliary lines on the liquid crystal display panel, a plurality of thin film transistors, each at intersections between the gate lines and data lines, a plurality of liquid crystal cells, each connected to one of the thin film transistors, a plurality of storage capacitors, each corresponding to one of the liquid crystal cells, wherein the storage capacitors of laterally adjacent liquid crystal cells are electrically interconnect via at least one of the auxiliary lines.

In another aspect, a liquid crystal display device includes a liquid crystal display panel, a plurality of thin film transistors on the liquid crystal display panel, a plurality of pixels, each corresponding to the thin film transistors, a plurality of auxiliary lines, each provided on the liquid crystal display panel for applying a first voltage, and a plurality of storage capacitors, each connected to a corresponding one of the auxiliary lines to charge a second voltage from the data line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 9 depicts a polarity pattern of a data signal according to a 1-dot inversion system;

FIG. 10 depicts a polarity pattern of a data signal according to a 2-dot inversion system.

DETAILED DESCRIPTION OF THE PREFERRED EMBODIMENTS

Figure 1:
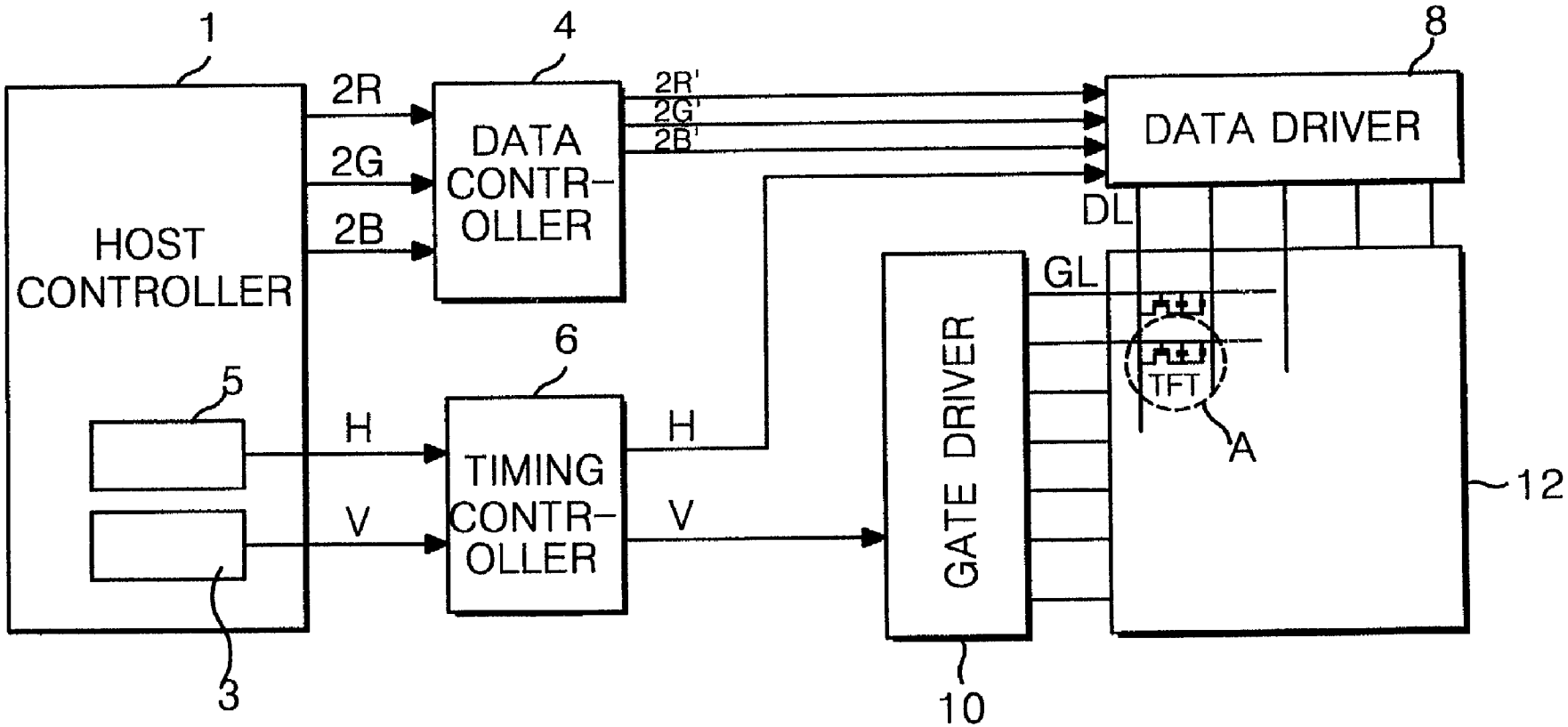
FIG.1 CONVENTIONAL ART
FIG. 1 is a schematic block diagram showing a conventional liquid crystal display device.
Figure 2:
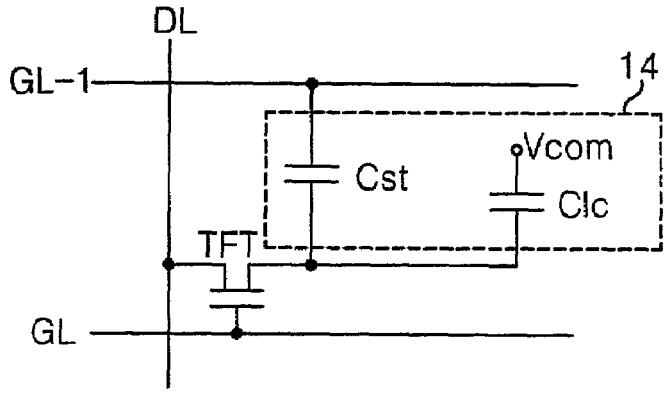
FIG.2 CONVENTIONAL ART
FIG. 2 is an equivalent circuit diagram of a pixel A of the liquid crystal display panel shown in FIG. 1.
Figure 3:
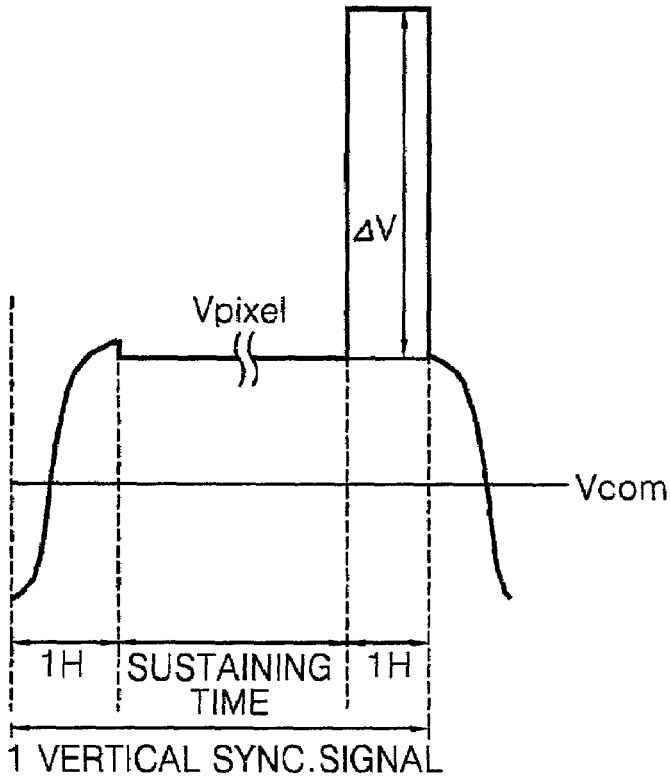
FIG.3 CONVENTIONAL ART
FIG. 3 is a waveform diagram representing a variation of a pixel voltage on a time basis according to the effect of the pre-stage gate.
Figure 4:
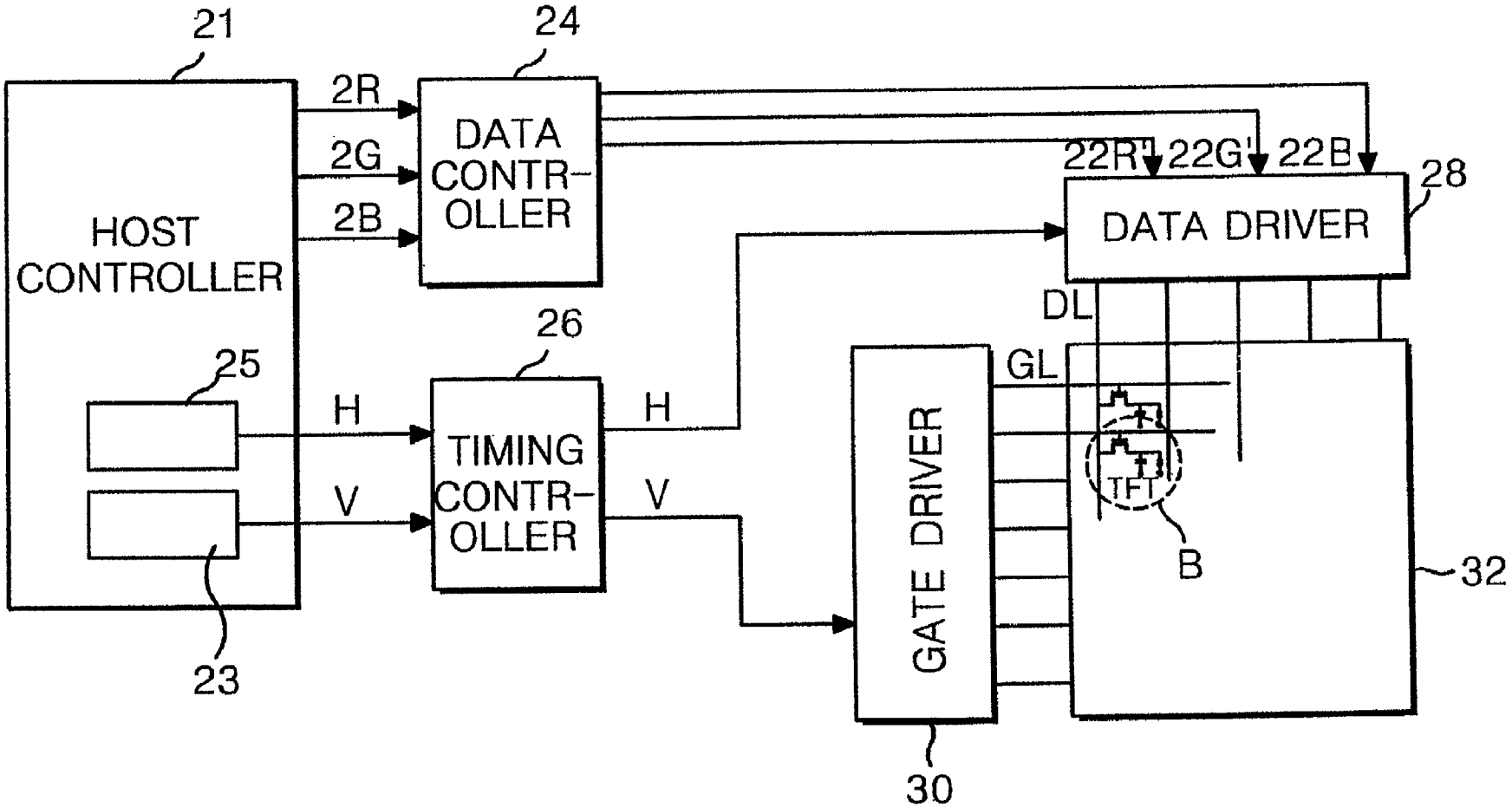
FIG. 4 is a schematic block diagram showing an exemplary configuration of a liquid crystal display device according to the present invention.

FIG. 4 shows an exemplary liquid crystal display device according to the present invention. In FIG. 4, a liquid crystal display device may include a liquid crystal display panel 32 for displaying image data corresponding to video signals, a host controller 21 for generating video signals 2R, 2G and 2B, a 30 Hz vertical synchronizing signal V and a horizontal synchronizing signal H, a data driver 28 for applying the video signals to data lines DL of the liquid crystal display panel 32, a data controller 24 arranged between the host controller 21 and the data driver 28 to apply the video signals 2R, 2G and 2B from the host controller 21 to the data driver 28, a gate driver 30 for applying a scanning signal to gate lines GL of the liquid crystal display panel 32, and a timing controller 26 arranged between the host controller 21 and the gate driver 30 to apply the vertical and horizontal synchronizing signals V and H from the host controller 21 to the data driver 28 and the gate driver 30, respectively.

The host controller 21 may apply the video signals 2R, 2G and 2B stored in a video RAM (not shown), for example, to the data controller 24. In addition, the host controller 21 may include a vertical synchronizing signal oscillator 23 for creating the 30 Hz vertical synchronizing signal V, and a horizontal synchronizing signal oscillator 25 for creating the horizontal synchronizing signal H. The vertical synchronizing signal oscillator 23 may generate a 30 Hz vertical synchronizing signal V and apply it to the timing controller 26. The horizontal synchronizing signal oscillator 25 may generate a horizontal synchronizing signal H and apply it to the timing controller 26.

The data controller 24 may receive the video signals 2R, 2G and 2B from the host controller 21 to apply the video signals 22R', 22G' and 22B' to the data driver 28 on a serial transmission basis. The timing controller 26 may apply the 30 Hz vertical synchronizing signal V from the host controller 21 to the gate driver 10, and it may apply the horizontal synchronizing signal H from the host controller 21 to the data driver 28.

The data driver 28 may be synchronized with the horizontal synchronizing signal H from the timing controller 26 to apply video signals 22R', 22G' and 22B' from the data controller 24 to the data lines DL of the liquid crystal display panel 32, line by line. More specifically, the data driver 28 may latch each of red (R), green (G) and blue (B) data inputted sequentially in conformity to a clock of the horizontal synchronizing signal H from the timing controller 26, thereby changing the timing system from the dot at a timing scanning into the line at a timing scanning. Subsequently, the data driver 28 may transfer data stored in a first latch (not shown) to a second latch (not shown) in conformity to a transfer enable signal every period of the horizontal synchronizing signal H. The data stored in the second latch may be converted into an analog voltage by an analog to digital converter (not shown) and then applied to the data lines DL via a current buffer (not shown).

The gate driver 30 may be synchronized with the vertical synchronizing signal V from the timing controller 26 to sequentially create a gate pulse for applying the video signals 22R', 22G' and 22B' from the data lines DL to each pixel, thereby applying the gate pulse to gate lines GL of the liquid crystal display panel 32. More specifically, the gate driver 30 may include a shift register (not shown) for shifting a start pulse, in which a logic input value of the vertical synchronizing signal V is high, sequentially at one line time interval, a level shifter (not shown) for converting an output logic level of the shift register into an ON/OFF voltage of the gate line GL, and a current buffer (not shown) for amplifying a current in consideration of a load of the gate line GL. The configuration sequentially applies a scanning pulse, which is an ON/OFF signal, to the gate lines GL.

Figure 5:
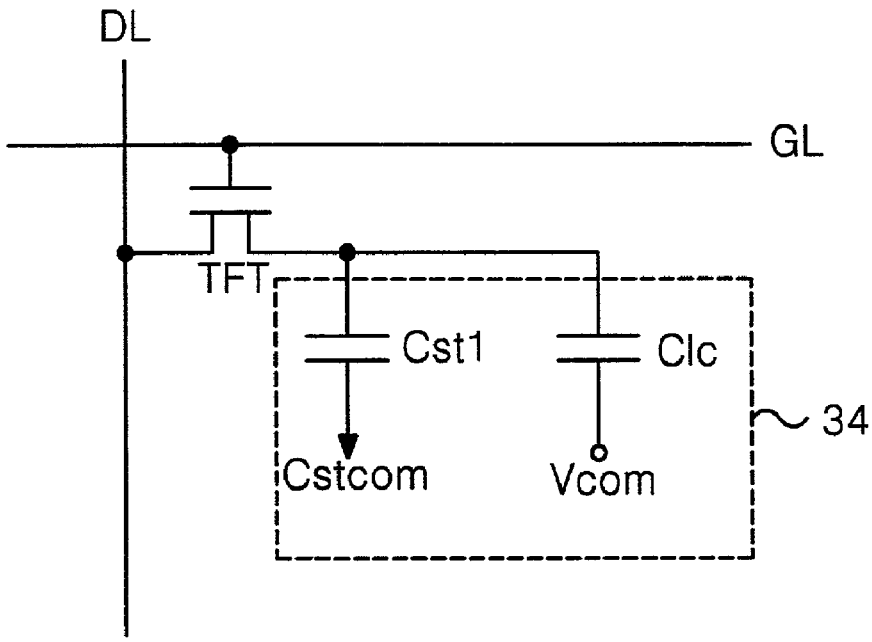
FIG. 5 is an equivalent circuit diagram of an exemplary pixel B of the liquid crystal display panel shown in FIG. 4.

FIG. 5 is an equivalent circuit diagram of an exemplary pixel B of the liquid crystal display panel shown in FIG. 4. In FIG. 5, the liquid crystal display panel 32 may include a thin film transistor (TFT) arranged at each intersection between the gate lines GL and the data lines DL to serve as a switch, and a pixel electrode 34 connected to a drain terminal of the TFT. The TFT acts as a switch that loads and breaks a signal voltage onto and from a pixel electrode 34. A gate terminal of the TFT may be connected to the gate line GL, and a source terminal of the TFT may be connected to the data line DL. Furthermore, a drain terminal of the TFT is connected to the pixel electrode 34.

The pixel electrode 34 may include a storage capacitor Cst1 arranged between a storage common terminal Cstcom and the drain terminal of the TFT, and a liquid crystal cell Clc connected between the drain terminal of the TFT and a common voltage terminal Vcom at an upper substrate (not shown). The pixel electrode 34 may be in an area that transmits and blocks light. The pixel electrode 34 applies a data voltage to a liquid crystal layer (not shown), thereby displaying image data. More specifically, the shift register of the data driver 28 is supplied with video signals sequentially one pixel at a time to store the video signals corresponding to the data lines DL. Subsequently, the gate driver 30 outputs a gate line selection signal to sequentially select any one of a plurality of gate lines GL. A plurality of TFTs that may be connected to the selected gate line GL are turned ON to apply video signals stored in the shift register of the data driver 28 to the source terminal of the TFT, thereby displaying the video signals on the liquid crystal display panel 32. Thereafter, the switching operation is repeated to display the video signals on the liquid crystal display panel 32.

By implementing the switching operation of the TFT, a pixel voltage is applied to the pixel electrode 34 to display image data. A storage capacitor Cst1 is used to improve a sustaining characteristic of a liquid crystal application voltage, stabilize a gray scale display, and maintain a pixel information during a non-selection interval of a pixel. The storage capacitor Cst1 is charged with a desired data voltage from the data line in connection with the storage common line Cstcom as an auxiliary line when a gate pulse is scanned at the gate line GL.

Figure 6:
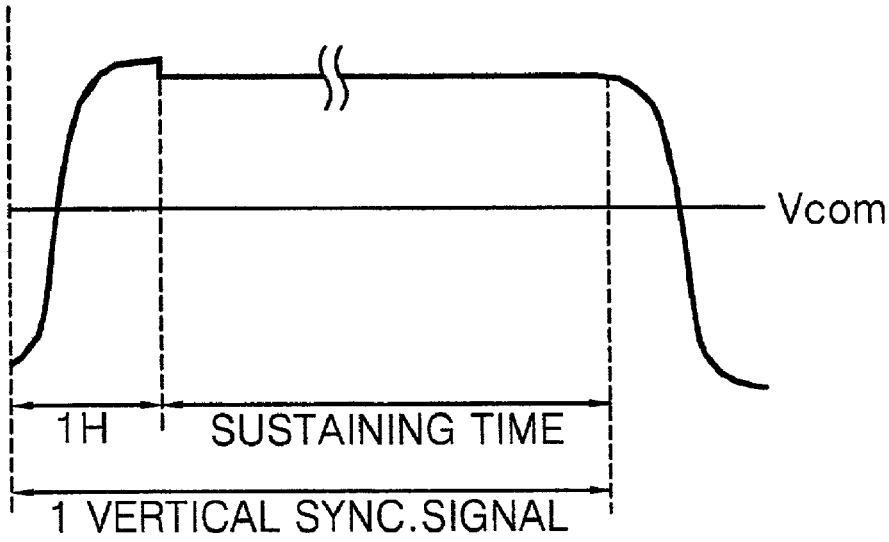
FIG. 6 is an exemplary waveform diagram representing a variation of a pixel voltage on a time basis according to the present invention.

FIG. 6 is an exemplary waveform diagram representing a variation of a pixel voltage on a time basis according to the present invention. In FIG. 6, the storage capacitor Cst1 charges a positive voltage in an 1H interval when a scanning pulse is turned ON. Accordingly, the voltage charged on the storage capacitor Cst1 is maintained during 1 frame after a scanning pulse was turned OFF. Since the storage capacitor Cst1 is connected to the storage common terminal Cstcom, a high voltage at the pre-stage gate line GL-1 is not transferred to the storage capacitor Cst1 upon data charging of the storage capacitor Cst1 at the gate line GL (not shown). Accordingly, electric charges on the storage capacitor Cst1 are not influenced by a voltage derived from the pre-stage gate line GL-1 when it is sustained during 1 frame, so that it becomes possible to maintain a voltage charged in the storage capacitor Cst1 at a stable state during 1 frame. As compared with the prior art in which a rising time causes a liquid crystal displacement affected by of the pre-stage gate line GL-1 as follows:

$$\text{Rise Time}(\tau_{ON}) = \frac{r_1 * d^2}{\varepsilon_0 * \Delta\varepsilon * (5.0^2 - 1.0^2)} \tag{4}$$

According to equation (4), since there is no additional voltage derived from the pre-stage gate line GL-1, a charged voltage becomes 5.0V and a threshold voltage becomes 1.0V. The rise time according to the effect of the pre-stage gate as can be seen from equation (4) where a very large difference in a pixel voltage results in a relatively large rise time. In contrast, the effect of the pre-stage gate line GL-1 in the prior art, as seen from equation (3), results in a relatively short rise time. Under similar conditions, a response speed of the present invention is 9.3 times faster than a response speed in the prior art.

Figure 7:
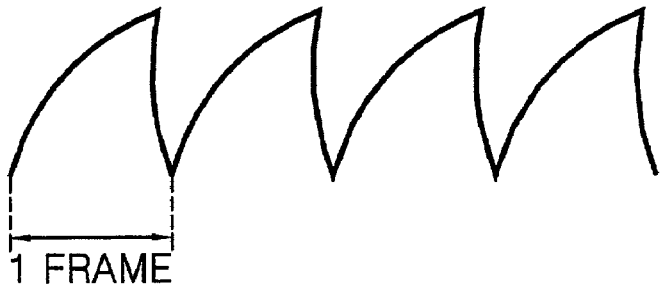
FIG. 7 is an exemplary waveform diagram representing a brightness change of the pixel.

As previously described, the storage capacitor Cst1 is connected to the separate storage common terminal Cstcom rather than the pre-stage gate line GL-1 to prevent the effect of the pre-stage gate line GL-1, so that a stable brightness can be obtained due to a stable rising time as shown in FIG. 7.

In FIG. 7, as a vertical synchronizing frequency is lowered from more than 60 Hz to 30 Hz, a brightness of the display is not changed. However, a flicker appears due to a deterioration of human visual characteristics, i.e., a difference between bright and dark objects, in accordance with driving the display with a 30 Hz vertical synchronizing signal V. This flicker can be eliminated by connecting the storage capacitor Cst1 to the storage common terminal Cstcom rather than the pre-stage gate line GL-1.

Figure 8:
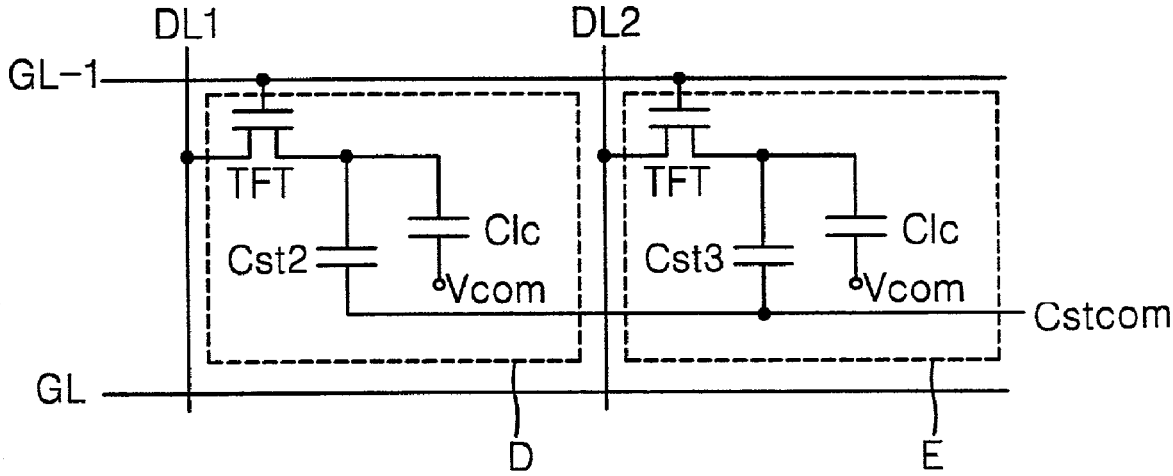
FIG. 8 is an exemplary equivalent circuit diagram of pixels arranged on a liquid crystal display panel according to the present invention.

FIG. 8 is an equivalent circuit diagram of pixels arranged on a liquid crystal display panel according to the present invention. In FIG. 8, storage capacitors Cst2 and Cst3 are commonly connected between adjacent first and second pixels D and E in a horizontal direction. The storage capacitor Cst2 of any one pixel is commonly connected to the storage capacitor Cst3 of a horizontally adjacent pixel, thereby remaining unaffected by a pre-stage gate. Accordingly, a flicker resulting from the effect of the pre-stage gate is not generated. Furthermore, the same effect can be obtained by connecting the storage capacitor Cst2 or Cst3 of any one pixel to the storage common terminal Cstcom and to the storage capacitor Cst2 or Cst3 of a horizontally adjacent pixel.

For example, if the 1-dot inversion system is applied to an end mode, then the polarity of a data voltage is inverted as shown in FIG. 9 whenever the data line DL and the gate line GL are changed and the frame is changed. If the present invention is applied to the 1-dot inversion system, then a flicker phenomenon occurs due to a deterioration of human visual characteristics resulting from a low vertical synchronizing signal in the present invention. In order to eliminate such a flicker, the 2-dot inversion system according to the present invention is applied.

Figure 11A:
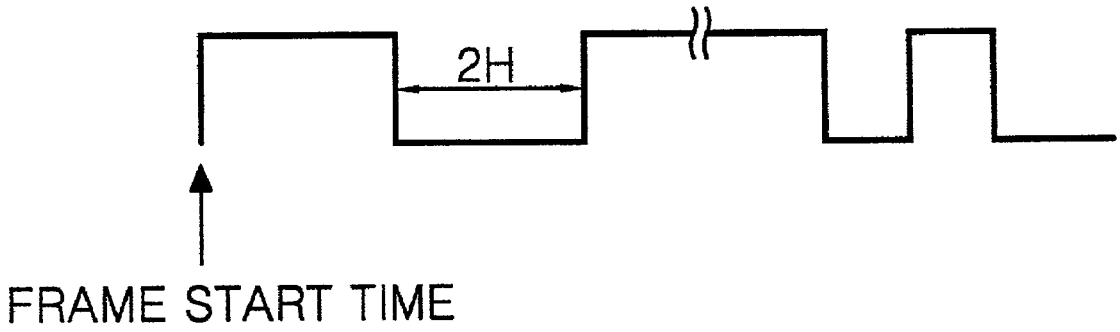
FIGS. 11A and 11B are waveform diagrams of polarity control signals applied to an exemplary source driver of the liquid crystal display panel according to the 2-dot system.
Figure 11B:
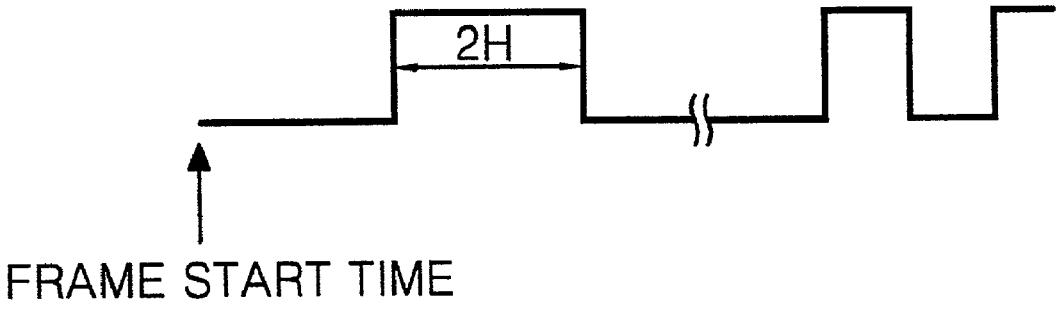

FIG. 10 shows a polarity pattern of a data signal according to a 2-dot inversion system. In FIG. 10, polarity of a data voltage is inverted every two gate lines, every data line and every frame. In other words, in the 2-dot inversion system, the polarities of data signals applied to the liquid crystal display panel are inverted every data line and every two gate lines of the liquid crystal display panel, and every frame. In such a liquid crystal display panel driving method employing the 2-dot inversion system, a polarity control signal applied to the data driver is inverted every two horizontal synchronous intervals as shown in FIGS. 11A and 11B. Furthermore, the polarity control signal is inverted every frame. Such a liquid crystal display panel driving method employing the 2-dot inversion system minimizes a voltage ΔVp between a positive voltage (+) and a negative voltage (−) by inverting the polarities of video signals every two gate lines or every data line and every frame, thereby preventing a generation of flicker.

However, in the case of applying a 30 Hz vertical synchronizing signal according to the present invention to the 2-dot inversion system, a flicker phenomenon occurs due to a deterioration of human visual characteristics resulting from a low vertical synchronizing signal. In order to overcome this problem, the storage capacitor Cst1 according to the present invention is connected to the drain terminal of the TFT and to the storage common terminal Cstcom as a separate auxiliary line rather than the pre-stage gate line, thereby preventing a liquid crystal displacement caused by a voltage rise occurring upon data charging at the pre-stage gate line. Also, the storage capacitor Cst2 is commonly connected to the storage capacitor Cst3 being horizontally adjacent thereto to thereby obtain the same effect as mentioned above. Accordingly, a voltage rise caused by the effect of the pre-stage gate is eliminated, so that it becomes possible to prevent a deterioration of picture quality and a generation of flicker in spite of a low vertical synchronizing signal as well as to reduce power consumption owing to a use of a low vertical synchronizing signal.

It will be apparent to those skilled in the art that various modifications and variations can be made in the liquid crystal display device of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a plurality of data lines on a liquid crystal display panel;

a plurality of gate lines on the liquid crystal display panel orthogonal to the plurality of data lines;

a plurality of thin film transistors on the liquid crystal display panel, each arranged at intersections between the data lines and the gate lines;

a plurality of pixels, each pixel arranged at the intersections between the data lines and the gate lines;

a gate driver for applying a scanning pulse to the gate lines, wherein each gate line corresponds to one row of pixels;

a data driver for applying data to the data lines;

a timing controller for applying a timing signal to the gate driver and the data driver;

a host controller for applying the data to the data driver and applying a horizontal synchronizing signal having a first frequency and a vertical synchronizing signal having a second frequency less than 60 Hz to the timing controller to control the data driver and the timing controller;

a plurality of auxiliary lines connected to a common voltage source, each auxiliary line provided on the liquid crystal display panel for applying a first voltage; and a plurality of storage capacitors, each connected to a corresponding one of the auxiliary lines to charge a second voltage from the data line in a scanning interval of a scanning line.

2. The device according to claim 1, wherein the storage capacitor of one pixel is commonly connected to the storage capacitor of a horizontally adjacent pixel.

3. The device according to claim 1, wherein the second frequency of the vertical synchronizing signal is about 30 Hz.

4. The device according to claim 1, wherein the host controller includes:

a data controller for applying the data to the data driver;

a vertical synchronizing signal oscillator for generating the vertical synchronizing signal; and a horizontal synchronizing signal oscillator for generating the horizontal synchronizing signal.

5. The device according to claim 1, wherein the liquid crystal display device is driven by a 1-dot inversion system.

6. The device according to claim 1, wherein the liquid crystal display device is driven by a 2-dot inversion system.

7. A method for driving a liquid crystal display device that includes a plurality of data lines on a liquid crystal display panel, a plurality of gate lines on the liquid crystal display panel orthogonal to the plurality of data lines, a plurality of thin film transistors on the liquid crystal display panel, each arranged at intersections between the data lines and the gate lines, and a plurality of pixels, each pixel arranged at the intersections between the data lines and the gate lines, the method comprising:

applying a scanning pulse to the gate lines using a gate driver, wherein each gate line corresponds to one row of pixels;

applying data to the data lines using a data driver;

applying a timing signal to the gate driver and the data driver using a timing controller;

applying the data to the data driver and applying a horizontal synchronizing signal having a first frequency and a vertical synchronizing signal having a second frequency less than 60 Hz to the timing controller to control the data driver and the timing controller using a host controller;

applying a first voltage to a plurality of auxiliary lines from a common voltage source connected thereto, each auxiliary line provided on the liquid crystal display panel; and charging a plurality of storage capacitors, each connected to a corresponding one of the auxiliary lines, with a second voltage from the data line during a scanning interval of a scanning line.

8. The method according to claim 7, wherein the storage capacitor of one pixel is commonly connected to the storage capacitor of a horizontally adjacent pixel.

9. The method according to claim 7, wherein the second frequency of the vertical synchronizing signal is about 30 Hz.

10. The method according to claim 7, wherein the host controller includes:

a data controller for applying the data to the data driver;

a vertical synchronizing signal oscillator for generating the vertical synchronizing signal; and a horizontal synchronizing signal oscillator for generating the horizontal synchronizing signal.

11. The method according to claim 7, further including driving the liquid crystal display device by a 1-dot inversion system.

12. The method according to claim 7, further including driving the liquid crystal display device by a 2-dot inversion system.

13. The method according to claim 12, wherein a polarity of the data applied to the data driver is inverted at every two horizontal synchronous intervals.

14. The method according to claim 13, wherein the two horizontal synchronous intervals correspond to two gate line intervals.

15. The method according to claim 12, wherein a polarity of the data applied to the data driver is inverted every frame.

16. A liquid crystal display device, comprising:

a liquid crystal display panel;

a plurality of gate lines on the liquid crystal display panel;

a plurality of data lines on the liquid crystal display panel orthogonal to the plurality of gate lines;

a plurality of auxiliary lines on the liquid crystal display panel connected to a common voltage source for applying a first voltage;

a plurality of thin film transistors, each at intersections between the gate lines and data lines;

a plurality of liquid crystal cells, each connected to one of the thin film transistors, wherein the thin film transistors corresponding to one row of the liquid crystal cells are commonly connected to one gate line;

a host controller for applying a horizontal synchronizing signal having a first frequency and a vertical synchronizing signal having a second frequency of about 30 Hz; and a plurality of storage capacitors, each corresponding to one of the liquid crystal cells, wherein the storage capacitors of laterally adjacent liquid crystal cells are electrically interconnected via at least one of the auxiliary lines and are charged with a second voltage from a corresponding one of the data lines during application of a gate signal to the gate line.

17. The device according to claim 16, wherein a first electrode of each liquid crystal cell is commonly connected to a first electrode of each storage capacitor and a drain electrode of each thin film transistor.

18. The device according to claim 17, wherein a second electrode of each liquid crystal cell is electrically connected to a common voltage terminal.

19. A liquid crystal display device, comprising:

a liquid crystal display panel;

a plurality of thin film transistors on the liquid crystal display panel;

a plurality of pixels, each corresponding to the thin film transistors, wherein each of the thin film transistors in one row of pixels are commonly connected to one scanning line;

a plurality of auxiliary lines connected to a common voltage source, each auxiliary line provided on the liquid crystal display panel for applying a first voltage;

a host controller for applying a horizontal synchronizing signal having a first frequency and a vertical synchronizing signal having a second frequency of about 30 Hz; and a plurality of storage capacitors, each connected to a corresponding one of the auxiliary lines to charge a second voltage from a data line in a scanning interval of the scanning line.

20. The device according to claim 19, wherein the storage capacitor of one pixel is commonly connected to the storage capacitor of a horizontally adjacent pixel.

* * * * *